US011873695B2

(12) United States Patent
Mireles et al.

(10) Patent No.: US 11,873,695 B2
(45) Date of Patent: Jan. 16, 2024

(54) BLOWOUT PREVENTER APPARATUS AND METHOD

(71) Applicant: National Oilwell Varco, L.P., Houston, TX (US)

(72) Inventors: Lydia Mireles, Houston, TX (US); Cesar J. Gonzalez, Katy, TX (US); David E. Hill, Spring, TX (US); Nathan Follett, Houston, TX (US); Vaishali Bhuvela, Katy, TX (US); Ali Al-Quraishi, Katy, TX (US)

(73) Assignee: National Oilwell Varco, L.P., Houston, TX (US)

( * ) Notice: Subject to any disclaimer, the term of this patent is extended or adjusted under 35 U.S.C. 154(b) by 320 days.

(21) Appl. No.: 17/059,952

(22) PCT Filed: May 29, 2019

(86) PCT No.: PCT/US2019/034401

§ 371 (c)(1),
(2) Date: Nov. 30, 2020

(87) PCT Pub. No.: WO2019/232052

PCT Pub. Date: Dec. 5, 2019

(65) Prior Publication Data

US 2021/0207450 A1 Jul. 8, 2021

Related U.S. Application Data

(60) Provisional application No. 62/678,860, filed on May 31, 2018.

(51) Int. Cl.
*E21B 33/06* (2006.01)

(52) U.S. Cl.
CPC ..... *E21B 33/06* (2013.01)

(58) Field of Classification Search
CPC ..... E21B 33/06
See application file for complete search history.

(56) References Cited

U.S. PATENT DOCUMENTS 3,050,132 A * 8/1962 Page ..... E21B 34/08 137/460
3,667,721 A 6/1972 Vujasinovic
3,915,424 A * 10/1975 LeRouax ..... F16J 15/26 251/1.2
4,858,882 A 8/1989 Beard et al.
4,949,785 A 8/1990 Beard et al.
(Continued)

OTHER PUBLICATIONS

International Search Report and Written Opinion dated Aug. 27, 2019 for Application No. PCT/US2019/034401.
(Continued)

*Primary Examiner* — Eric Keasel
(74) *Attorney, Agent, or Firm* — Conley Rose, P.C.

(57) ABSTRACT

An annular elastomeric packer for a blowout preventer includes a plurality of circumferentially spaced inserts, wherein at least one of the plurality of inserts includes a rib, and a foot pivotally coupled to the rib, and an elastomeric body coupled to the plurality of inserts and including an inner surface, wherein the foot is configured to resist deformation of the elastomeric body in response to the blowout preventer actuating from a first position to a second position.

10 Claims, 14 Drawing Sheets

(56) References Cited

U.S. PATENT DOCUMENTS

| | | | |
|---|---|---|---|
| 5,116,017 | A | 5/1992 | Granger et al. |
| 6,318,482 | B1 | 11/2001 | Fidtje |
| 2012/0227987 | A1 | 9/2012 | Castriotta et al. |
| 2015/0144356 | A1 | 5/2015 | DeOcampo et al. |
| 2015/0275609 | A1 | 10/2015 | Liotta et al. |
| 2018/0010410 | A1 | 1/2018 | Jones et al. |
| 2018/0066492 | A1 | 3/2018 | Arteaga et al. |

OTHER PUBLICATIONS

Extended European Search Report dated Jan. 4, 2022, for Application No. EP 19811886.1.

* cited by examiner

BLOWOUT PREVENTER APPARATUS AND METHOD

CROSS-REFERENCE TO RELATED APPLICATIONS

This application is a 35 U.S.C. § 371 national stage application of PCT/US2019/034401 filed May 29, 2019, and entitled "Blowout Preventer Apparatus and Method," which claims benefit of U.S. provisional patent application No. 62/678,860 filed May 31, 2018, and entitled "Blowout Preventer Apparatus and Method" each of which is incorporated herein by reference in its entirety.

STATEMENT REGARDING FEDERALLY SPONSORED RESEARCH OR DEVELOPMENT

Not applicable.

BACKGROUND

Hydrocarbon drilling systems utilize drilling fluid or mud for drilling a wellbore in a subterranean earthen formation. In some offshore applications, a blowout preventer (BOP) is installed at a subsea wellhead that extends from the sea floor, where the BOP is configured to control the inlet and outlet of fluid from a wellbore extending into a subterranean earthen formation below the sea floor, and particularly, to confine well fluid in the wellbore in response to a "kick" or rapid influx of formation fluid into the wellbore. An individual BOP stack may include both ram BOPs and annular BOPs. Ram BOPs include one or more rams that extend towards the center of the wellbore upon actuation to restrict flow through the ram BOP. In some applications, the inner sealing surface of each ram of the ram BOP is fitted with an elastomeric packer for sealing the wellbore. Annular BOPs are configured to close or seal against the outer surface of a tubular member, such as a drill string, extending through the BOP stack. Annular BOPs generally include an annular elastomeric packer engaged by a piston, whereupon actuation the annular packer is constricted about the drill string in response to displacement of the piston. In some applications, the sealing integrity between the packer and the drill pipe may be reduced in response to the flow or extrusion of the elastomeric material forming the packer in response to actuation of the annular BOP into the closed position.

SUMMARY OF THE DISCLOSED EMBODIMENTS

An embodiment of an annular elastomeric packer for a blowout preventer comprise a plurality of circumferentially spaced inserts, wherein at least one of the plurality of inserts comprises a rib, and a foot pivotally coupled to the rib, and an elastomeric body coupled to the plurality of inserts and comprising an inner surface, wherein the foot is configured to resist deformation of the elastomeric body in response to the blowout preventer actuating from a first position to a second position. In some embodiments, each insert comprises a rib coupled between a web and a heel, wherein the web comprises an interlock configured to overlap a mating surface of a web of an adjacently positioned insert in response to the blowout preventer actuating from a first position to a second position. In some embodiments, each insert comprises a rib coupled between a web and a heel, wherein at least one of the heel and the web comprise an interlock configured to circumferentially overlap a mating surface of at least one of the heel and the web of an adjacently positioned insert in response to the elastomeric packer actuating from a first position to a second position. In certain embodiments, the foot of each insert an interlock configured to circumferentially overlap a mating surface of the foot of an adjacently positioned insert in response to the elastomeric packer actuating from a first position to a second position. In certain embodiments, each insert comprises a biasing assembly configured to retract the foot towards a rib of the insert. In some embodiments, each insert further comprises a link pivotally coupled to the foot. In some embodiments, the link comprises a groove that receives an annular seal configured to sealingly engage a piston of the blowout preventer.

An embodiment of an annular blowout preventer comprises an outer housing, an elastomeric packer disposed in the housing, comprising a plurality of circumferentially spaced inserts, wherein at least one of the plurality of inserts comprises a rib coupled between a web and a heel, wherein the insert comprises an interlock configured to circumferentially overlap a mating surface of an adjacently positioned insert in response to the elastomeric packer actuating from a first position to a second position, and an elastomeric body coupled to the plurality of inserts and comprising an inner surface, and a piston slidably disposed in the housing and configured to actuate the elastomeric packer from the first position to the second position. In some embodiments, the piston is configured to actuate the elastomeric packer into sealing engagement against a tubular member. In some embodiments, the piston comprises an annular seal configured to sealingly engage the elastomeric body of the packer. In certain embodiments, the interlock of each insert slidably engages the mating surface of the adjacently positioned insert in response to the elastomeric packer actuating from the first position to the second position. In certain embodiments, the web of the insert comprises the interlock positioned at a first lateral side of the web and the mating surface positioned at a second lateral side of the web opposite the first lateral side. In some embodiments, the interlock of the insert is circumferentially spaced from the mating surface of the adjacently positioned insert when the elastomeric packer is in the first position. In some embodiments, each insert comprises a pivotally coupled foot that is configured to resist deformation of the elastomeric body in response to the blowout preventer actuating from a first position to a second position. In certain embodiments, the piston comprises an annular seal configured to sealingly engage the foot of each insert.

An embodiment of an annular elastomeric packer for a blowout preventer comprises a plurality of circumferentially spaced inserts, wherein at least one of the plurality of inserts comprises a rib coupled between a web and a heel and an interlock configured to overlap a mating surface of a web of an adjacently positioned insert in response to the elastomeric packer actuating from a first position to a second position, and an elastomeric body coupled to the plurality of inserts and comprising an inner surface. In some embodiments, the web of the insert comprises the interlock positioned at a first lateral side of the web and the mating surface positioned at a second lateral side of the web opposite the first lateral side. In some embodiments, the heel of the insert comprises the interlock positioned at a first lateral side of the heel and the mating surface positioned at a second lateral side of the heel opposite the first lateral side. In certain embodiments, the interlock of each insert slidably engages the mating surface of the adjacently positioned insert in response to the elastomeric packer actuating from the first position to the second position. In certain embodiments, each insert comprises a pivotally coupled foot that is configured to resist deformation of the elastomeric body in response to the blowout preventer actuating from a first position to a second position.

BRIEF DESCRIPTION OF THE DRAWINGS

For a detailed description of exemplary embodiments, reference will now be made to the accompanying drawings in which.

DETAILED DESCRIPTION

Figure 1:
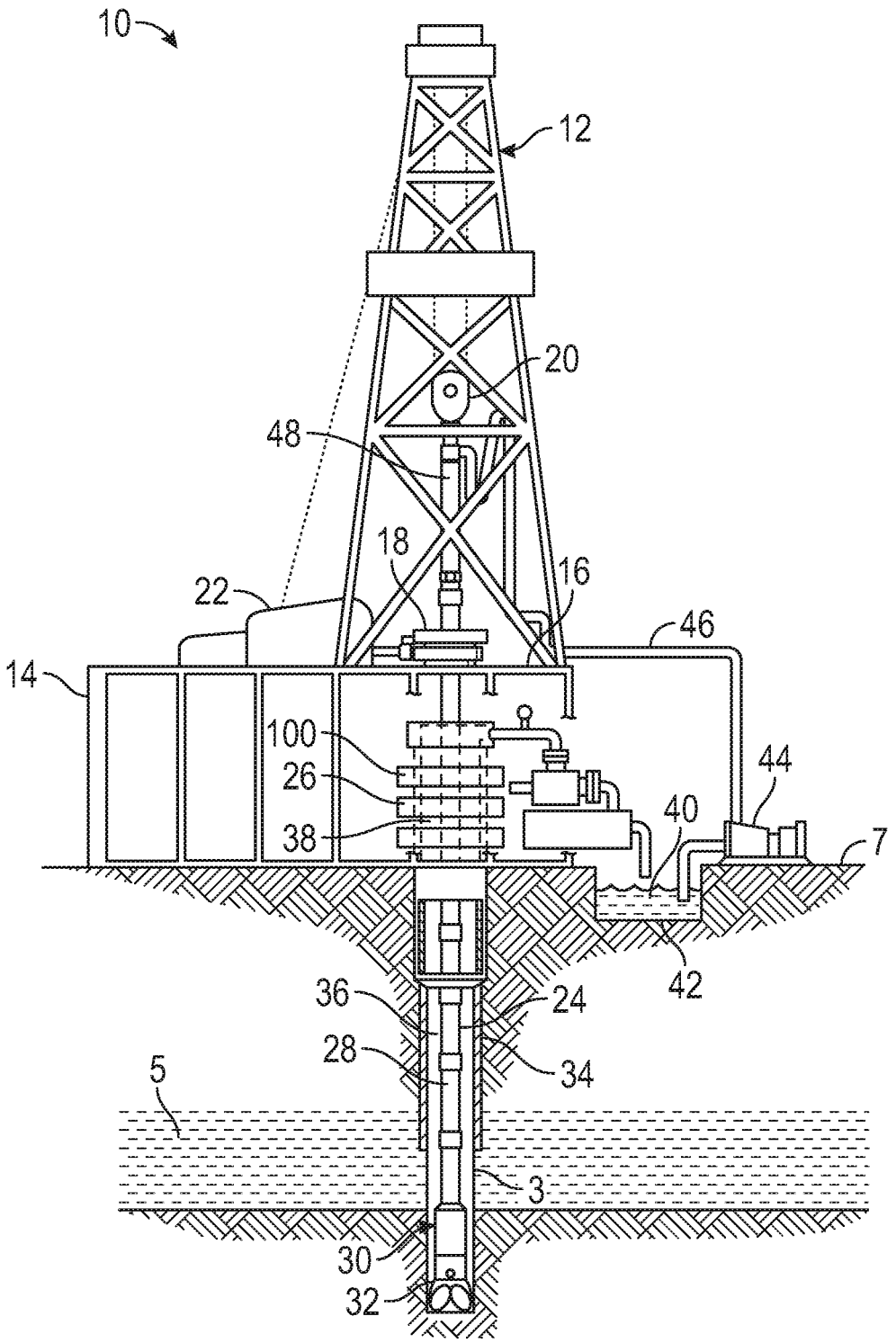
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, an embodiment of a well or drilling system 10 for drilling and/or producing a well is shown. In the embodiment of FIG. 1, drilling system 10 includes a derrick 12 supported by a drilling platform 14. Platform 14 has a drill deck or rig floor 16 supporting a rotary table 18 selectively rotated by a prime mover (not shown) such as an electric motor controlled by a motor controller. In this embodiment, derrick 12 includes a traveling block 20 controlled by a drawworks 22 for raising and lowering a drill string 24 suspended from traveling block 20. Drill string 24 of drilling system 10 extends downward through the rotary table 18, a BOP stack 26 including an annular BOP 100, and into a borehole 3 that extends into a subterranean earthen formation 5 from the surface 7. Drill string 24 is formed from a plurality of drill pipe joints 28 connected end-to-end. In this embodiment, a bottom-hole-assembly (BHA) 30 is attached to the lowermost joint 28 and a drill bit 32 is attached to the lower end of BHA 30 for drilling borehole 3. BHA 30 includes, as examples, a drill collar, a mud motor, as well as other sensors or tools. Drilling system 10 comprises a land-based drilling system in this embodiment; however, in other embodiments, drilling system 10 may comprise an offshore drilling system.

In this embodiment, drill bit 32 is rotated with rotary table 18 via drill string 24 and BHA 30. By rotating drill bit 32 with weight-on-bit (WOB) applied, the drill bit 32 disintegrates the earthen formation 5 to drill borehole 3, which may also be referred to as a wellbore. In some embodiments, a top-drive may be used to rotate the drill string 24 rather than rotation by the rotary table 18. In some embodiments, a downhole motor (mud motor) is disposed in the drilling string 24 to rotate the drill bit 32 in lieu of or in addition to rotating the drill string 24 from the surface 7. For example, the mud motor may rotate the drill bit 32 when a drilling fluid passes through the mud motor under pressure. In this embodiment, a casing or casing string 34 is installed and extends downward generally from the surface 7 into at least a portion of borehole 3. In some embodiments, casing 34 is cemented within the borehole 3 to isolate various vertically-separated earthen zones, preventing fluid transfer between the zones. BOP stack 26 is secured to the upper end of casing 34. In this embodiment, casing 34 comprises multiple tubular members, such as pieces of threaded pipe, joined end-to end to form liquid-tight or gas-tight connections, to prevent fluid and pressure exchange between the inner surface of casing 34 and a surrounding earthen zone.

An annular space or annulus 36 is formed between both the sidewall of borehole 3 and drill string 24 and between casing 34 and drill string 24. In other words, annulus 36 extends through borehole 3 and casing 34. BOP stack 26 includes an annular space or flow path 38 in fluid communication with annulus 36. Annular BOP 100 of the BOP stack 26 is generally configured to selectively seal the annular flow path 38 from annulus 36, and hence selectively seal annulus 36 at the surface 7 to thereby inhibit fluid contained in annulus 36 from discharging upward and out of borehole 3. As will be described further herein, annular BOP 100 includes an annular elastomeric sealing element configured to squeeze radially inward to sealingly engage an outer surface of a tubular (e.g., drill string 24, casing, drill pipe, drill collar, etc.) extending through annular BOP 100. In certain embodiments, an operator and/or drilling control system of drilling system 10 selectively and controllably opens and closes annular BOP 100 to allow, to restrict, or to inhibit the flow of drilling fluid or another fluid through flow path 38 and annulus 36. In this embodiment, drilling system 10 includes a drilling fluid circulation system to circulate drilling fluid or mud 40 down drill string 24 and back up annulus 36. Drilling fluid 40 generally functions to cool drill bit 32, remove cuttings from the bottom of borehole 3, and maintain a desired pressure or pressure profile in borehole 3 during drilling operations. The drilling fluid circulation system of drilling system 10 includes a drilling fluid reservoir or mud tank 42, a supply pump 44, a supply line 46 connected to the outlet of supply pump 44, and a kelly 48 for supplying drilling fluid 40 to the drill string 24.

Referring to FIGS. 2-9, an embodiment of the annular BOP 100 of drilling system 10 is shown. While annular BOP 100 is shown as part of drilling system 10, annular BOP 100 may be utilized in other well systems, including offshore well systems. In the embodiment of FIGS. 2-9, annular BOP 100 has a central or longitudinal axis 105 and generally includes a first or lower housing 102, a second or upper housing 140, a piston 180 slidably disposed in lower housing 102, an adapter ring 200 coupled to lower housing 102, and an annular, elastomeric packer 300 received in upper housing 140. Lower housing 102 of annular BOP 100 has a central bore or passage 104 extending between upper and lower ends of lower housing 102, where central passage 104 is defined by an inner surface 106. Lower housing 102 includes an annular shoulder 108, a first or upper port 110, and a second or lower port 112, where both ports 110, 112 extend radially between an outer surface of lower housing 104 and the inner surface 106. Additionally, the inner surface 106 of lower housing 102 includes an annular second or upper shoulder 114 against which adapter ring 200 is seated. Further, a pair of annular seals 116 are disposed on inner surface 106 of lower housing 102 where annular seals 116 sealingly engage piston 180.

In this embodiment, upper housing 140 of annular BOP 100 releasably couples to lower housing 102 via a connector assembly 210 disposed radially between lower housing 102 and upper housing 140. Upper housing 140 includes a central bore or passage 142 extending between upper and lower ends of the upper housing 140, where central passage 142 is defined by an inner surface 144. In this embodiment, a portion of the inner surface 144 of upper housing 140 comprises a concave or hemispherical surface 146 that guides the movement of elastomeric packer 300 during the actuation of annular BOP 100 and elastomeric packer 300 between a first or open position (shown in FIG. 2) and a second or closed position (shown in FIG. 3). Adapter ring 200 of annular BOP 100 is generally configured to retain piston 180 within the central passage 104 of lower housing 102. In this embodiment, adapter ring 200 includes an outer surface 202 that receives an annular first or outer seal 204 that sealingly engages the inner surface 106 of lower housing 102 and a pair of annular second or inner seals 206 that sealingly engage piston 180.

Piston 180 of annular BOP 100 is slidably disposed within the central passage 104 of lower housing 102 and is configured to actuate annular BOP 100 and elastomeric packer 300 between the open and closed positions in response to the communication of fluid pressure to central passage 104 from a hydraulic pressure source (e.g., a hydraulic accumulator, bottle, etc.). In this embodiment, piston 180 has an outer surface 182 extending between upper and lower ends of piston 180 and a central bore or passage 185. The outer surface 182 of piston 180 includes a pair of annular outer seals 184 disposed thereon that sealingly engage the inner surface 106 of lower housing 102. Additionally, the outer surface 182 of piston 180 includes an annular first or outer engagement surface 186 and an annular second or inner engagement surface 188.

Figure 10:
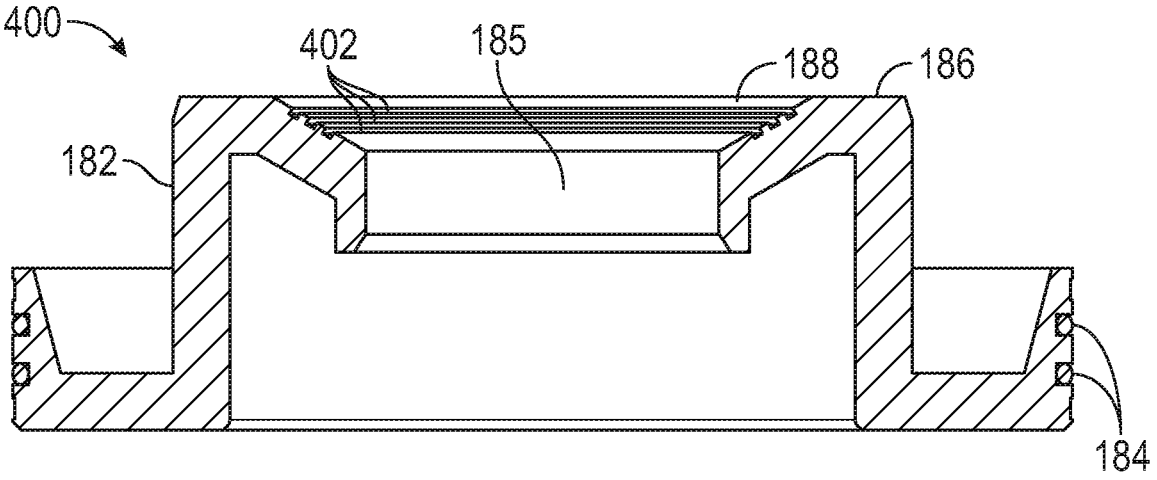
FIG. 10 is a side cross-sectional view of another embodiment of a piston of the annular BOP of FIG. 2 in accordance with the principles disclosed herein.

Outer engagement surface 186 of piston 180 is positioned at the upper end of piston 180 while inner engagement surface 188 comprises a frustoconical surface extending radially inwards from outer engagement surface 186. As shown particularly in FIG. 9, in this embodiment, an annular first packer seal 190 is disposed on outer engagement surface 186 while an annular second packer seal 192 is disposed on inner engagement surface 188. As will be described further herein, packer seals 190, 192 sealingly engage components of elastomeric packer 300. Although in this embodiment piston 180 includes a single annular seal 190 disposed on outer engagement surface 186 and a single annular seal 192 disposed on inner engagement surface 192, in other embodiments, engagement surfaces 186, 188 may include zero annular seals or more than one annular seals. For example, referring briefly to FIG. 10, another embodiment of a piston 400 of annular BOP 100 includes a plurality of annular seals 402 disposed on inner engagement surface 188 and no annular seals disposed on outer engagement surface 186.

Referring again to FIGS. 2-9, the sealing engagement provided by the seals 116 of lower housing 102 and the outer seals 184 of piston 180 define an annular first or closing chamber 220 (shown in FIG. 2) within central passage 104 of lower housing 102. Additionally, sealing engagement by outer annular seals 184 of piston 180 and the seals 204, 206 of adapter ring 200 define an annular second or opening chamber 222 (shown in FIG. 2) within central passage 104 of lower housing 102. Annular BOP 100 and elastomeric packer 300 are shown in the open position in FIG. 2, where fluid communication is allowed or provided through central passage 104 of lower housing 102 and central passage 142 of upper housing 140, thereby permitting the circulation of fluid along annular flowpath 38. Annular BOP 100 and elastomeric packer 300 may be actuated from the open position to the closed position where fluid flow along annular flowpath 38 is restricted via sealing engagement between packer 300 and the outer surface of drill string 24.

Figure 2:
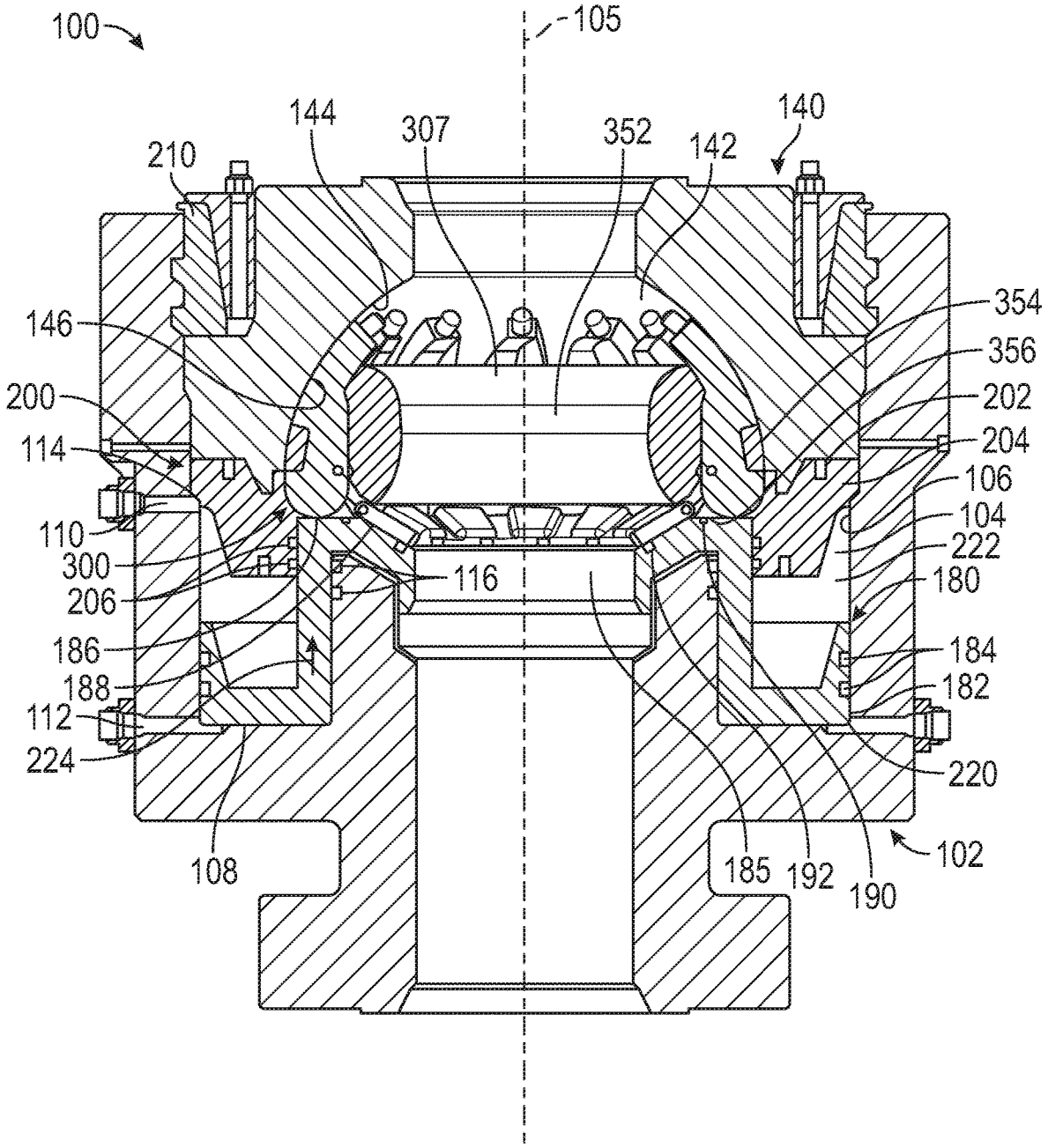
FIG. 2 is a side cross-sectional view of an embodiment of an annular BOP of the well system of FIG. 1 shown in a first position in accordance with the principles disclosed herein.
Figure 3:
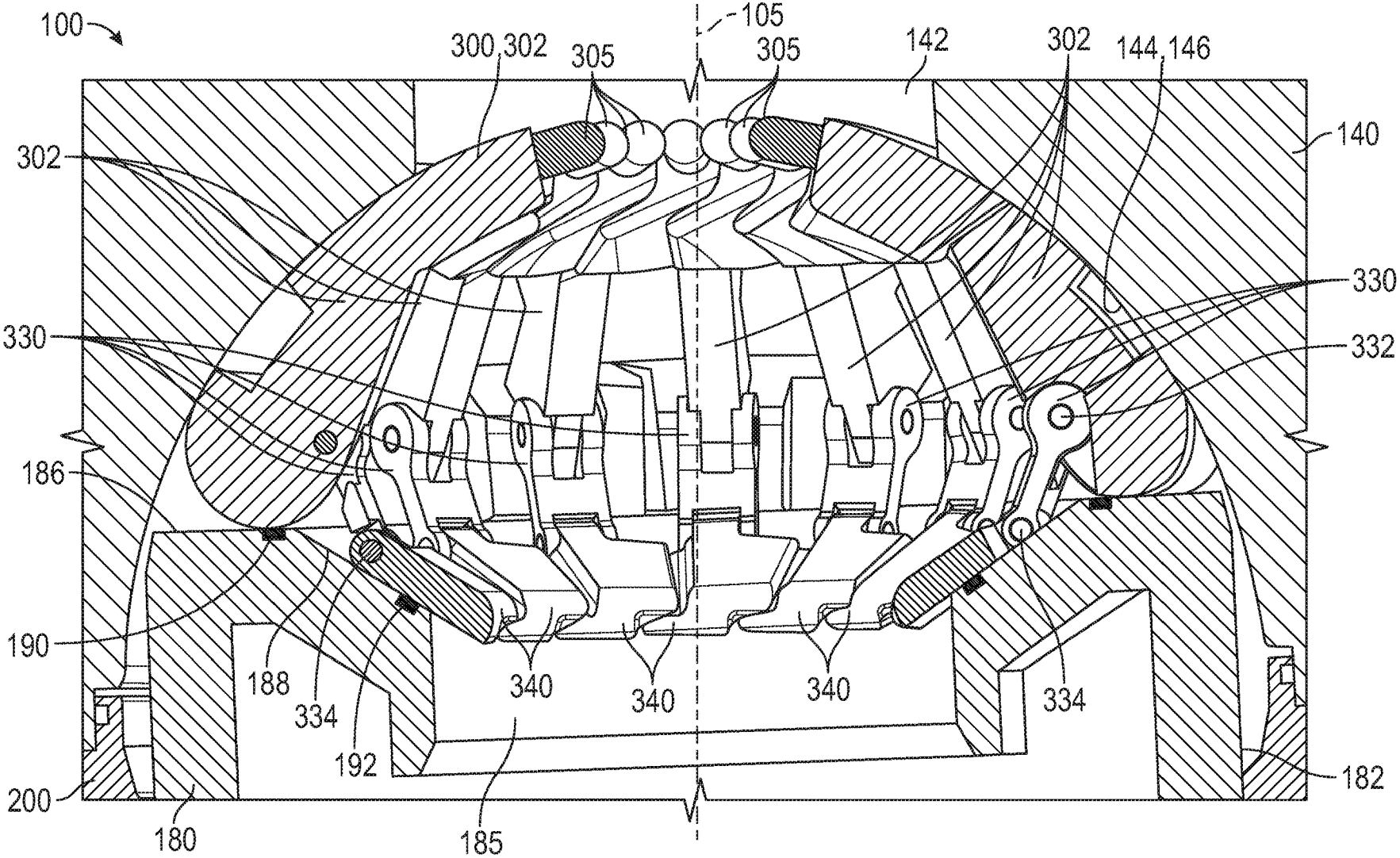
FIG. 3 is a side cross-sectional view of the annular BOP of FIG. 2 shown in a second position.
Figure 4:
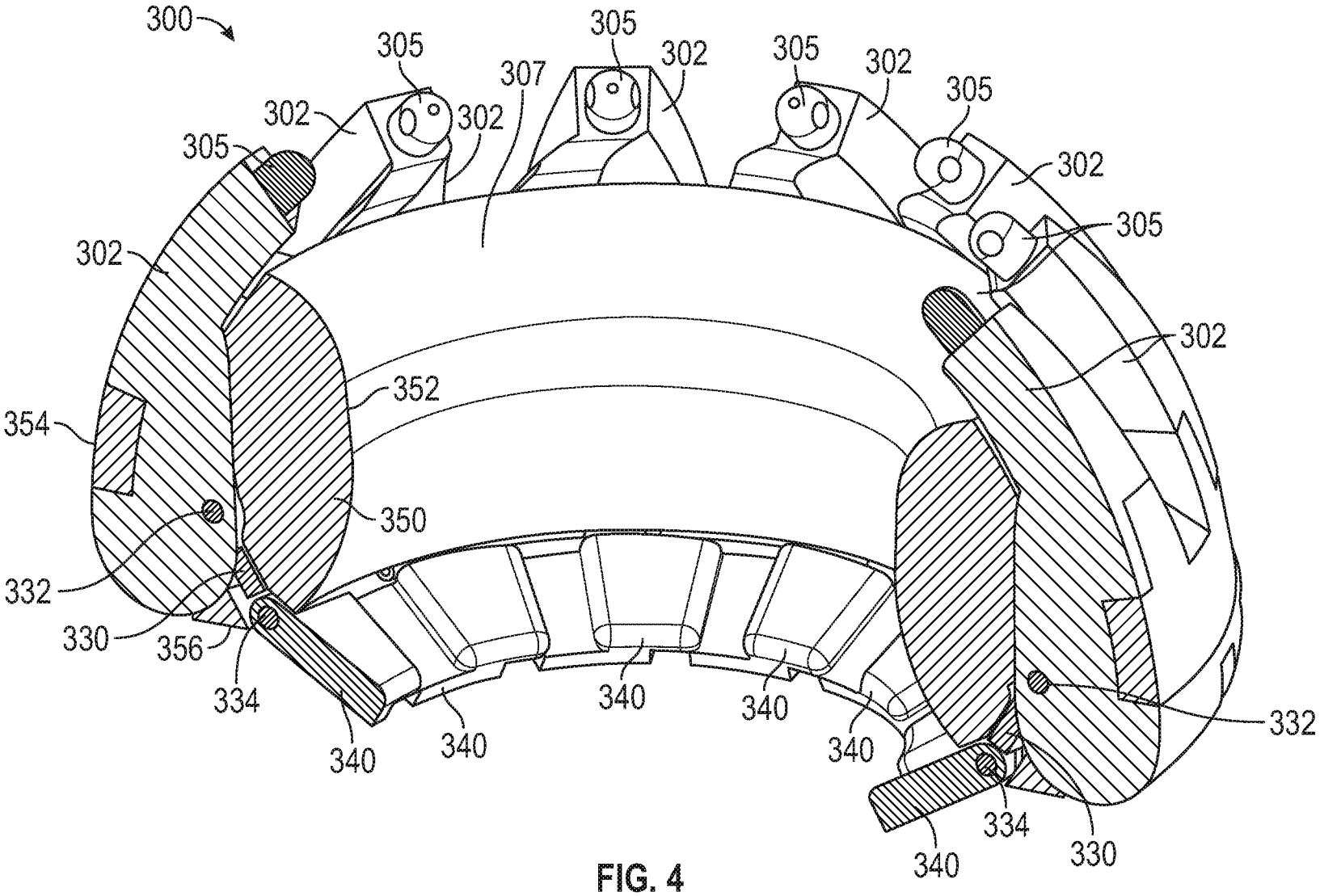
FIG. 4 is a perspective cross-sectional view of an embodiment of an elastomeric packer of the annular BOP of FIG. 2 in accordance with the principles disclosed herein.
Figure 5:
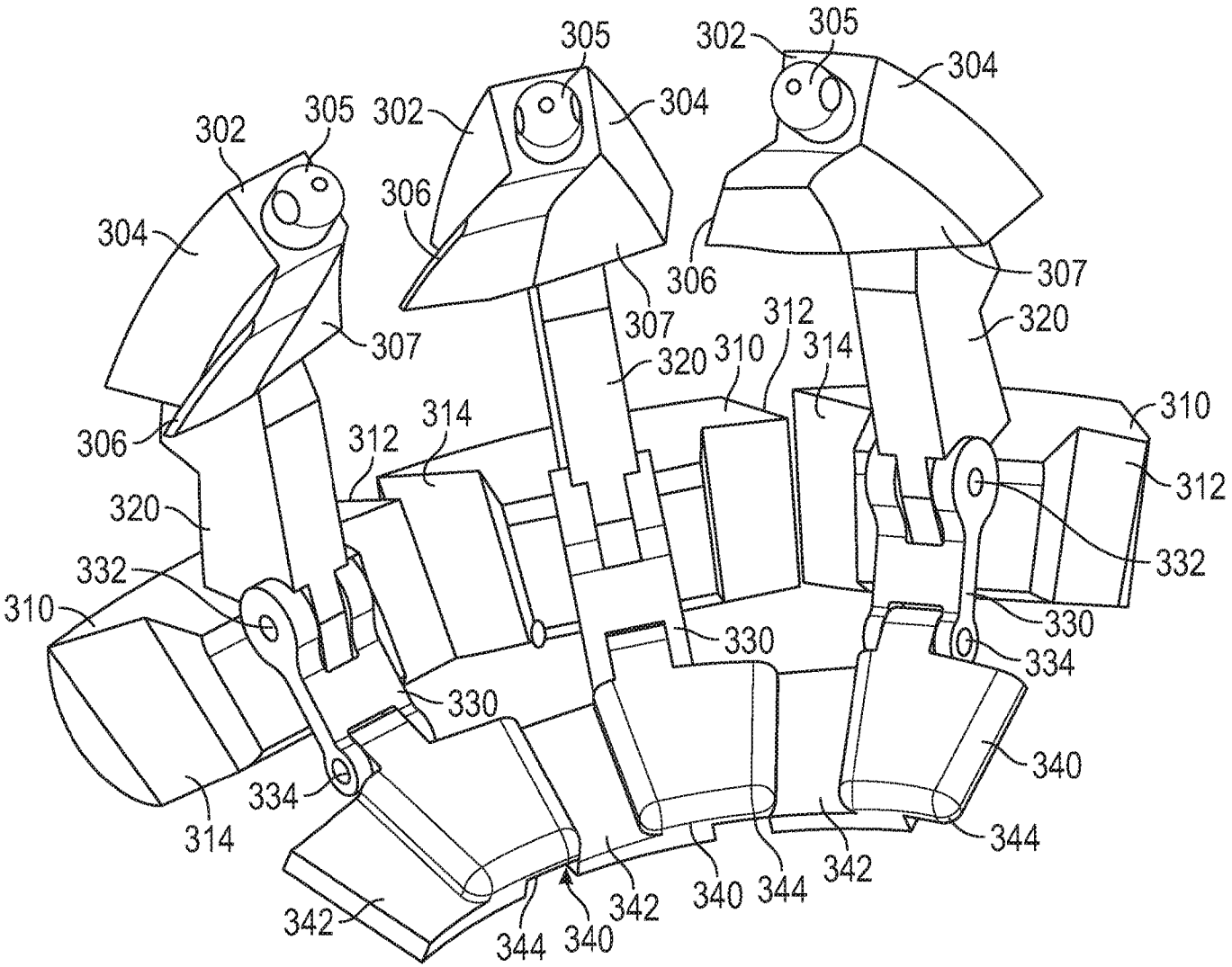
FIG. 5 is a perspective view of an embodiment of a plurality of inserts of the elastomeric packer of FIG. 4 in accordance with the principles disclosed herein.
Figure 6:
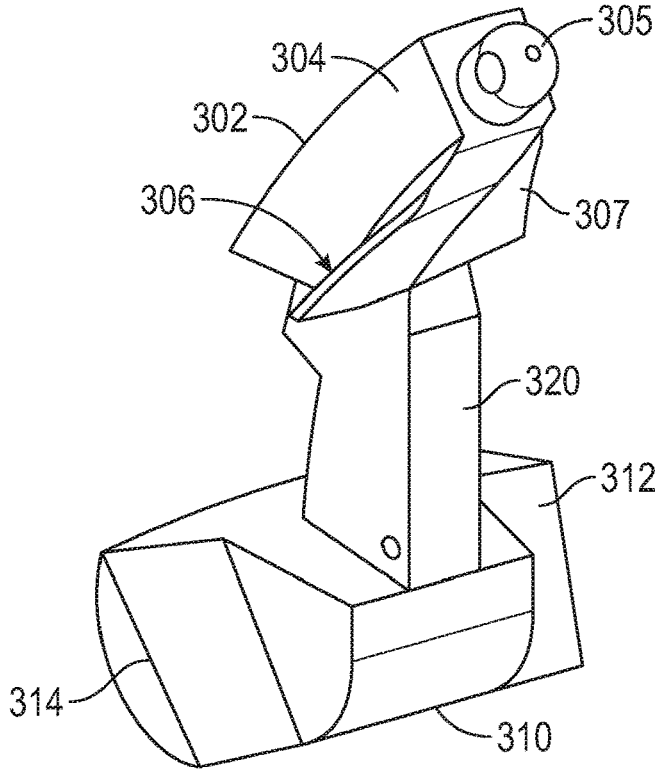
FIGS. 6-8 are perspective views of one of the inserts of FIG. 5.
Figure 7:
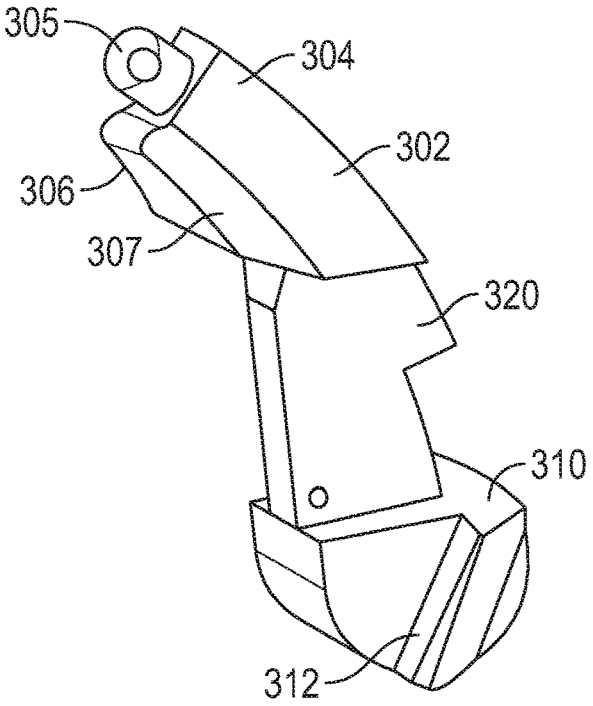
Figure 8:
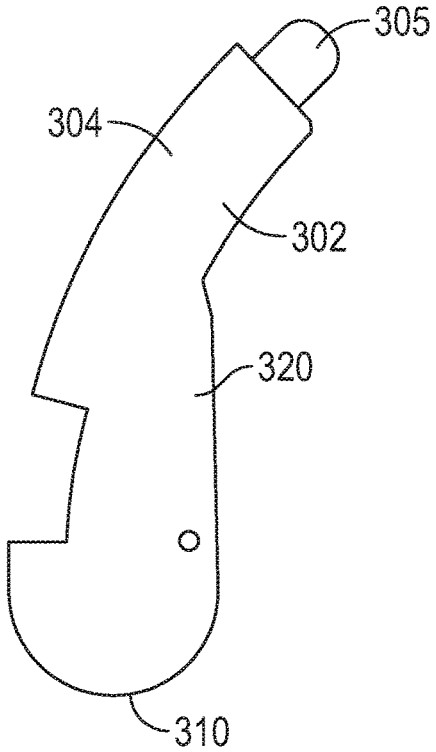
Figure 9:
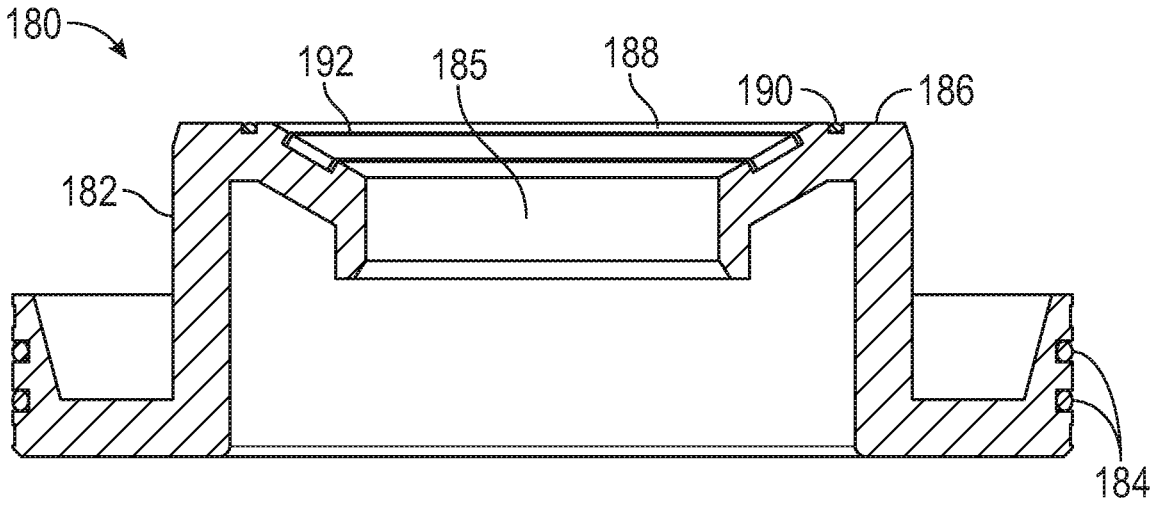
FIG. 9 is a side cross-sectional view of an embodiment of a piston of the annular BOP of FIG. 2 in accordance with the principles disclosed herein.

In this embodiment, to actuate annular BOP 100 and elastomeric packer 300 from the open position shown in FIG. 2 to the closed position shown in FIG. 3, closing chamber 220 of central passage 104 is hydraulically pressurized while hydraulic pressure within opening chamber 222 is concurrently reduced, thereby providing a hydraulic pressure closing force against piston 180 (shown schematically by arrow 224 in FIG. 2). Closing force 224 is axially directed towards the upper end of upper housing 140, causing piston 180 to be displaced axially upwards within central passage 104 until annular BOP 100 and elastomeric packer 300 are disposed in the closed position shown in FIG. 3. Conversely, annular BOP 100 and elastomeric packer 300 may be actuated from the closed position shown in FIG. 3 to the open position shown in FIG. 2 by hydraulically pressurizing opening chamber 222 while concurrently depressurizing closing chamber 220. The pressurization of opening chamber 222 and depressurization of closing chamber 220 provides an axially directed opening force against piston 180, causing piston 180 to be displaced through central passage 104 of lower housing 102 until annular BOP 100 and elastomeric packer 300 are disposed in the open position with the lower end of piston 180 in physical engagement with or disposed directly adjacent the inner surface 106 of lower housing 102. Fluid pressure may be communicated to chambers 220, 222 via ports extending radially through lower housing 102, where each port is in fluid communication with a hydraulic pressure source.

The elastomeric packer 300 of annular BOP 100 is configured to sealingly engage the outer surface of drill string 24 when annular BOP 100 and elastomeric packer 300 are actuated into the closed position. In certain embodiments, packer 300 is configured to seal central passage 142 of upper housing 140 and central passage 104 of lower housing 102 when there is no tubular member (e.g. drill string 24) extending through annular BOP 100 and BOP 100 and elastomeric packer 300 are actuated into the closed position. In other words, in at least some embodiments, when drill string 24 (or any other tubular member) does not extend through annular BOP 100, elastomeric packer 300 is configured to seal against itself to thereby restrict fluid flow along flowpath 38.

In this embodiment, elastomeric packer 300 of annular BOP 100 has a central or longitudinal axis and a central passage 307 extending between upper and lower ends thereof. Packer 300 generally includes a plurality of circumferentially spaced inserts 302 coupled to an annular elastomeric body 350. In certain embodiments, inserts 302 comprise a metallic material and are circumferentially arranged in a mold such that elastomeric body 350 may be molded thereto to form elastomeric packer 300. In this embodiment, elastomeric body 350 includes an annular inner surface 352 (shown in FIG. 2), an annular outer surface 354 (shown in FIG. 2), and an annular lower surface 358 (shown in FIG. 2). In the closed position of annular BOP 100 and elastomeric packer 300, inner surface 352 of elastomeric body 350 sealingly engages the outer surface of drill string 24 while outer surface 354 sealingly engages the hemispherical surface 146 of upper housing 140 while lower surface 356 sealingly engages the outer surface 182 of piston 180 to thereby restrict fluid flow along annular flowpath 38. When annular BOP 100 and elastomeric packer 300 are in the closed position and no tubular member extends through annular BOP 100, the inner surface 352 of elastomeric body 350 seals against itself to restrict fluid flow through annular BOP 100. In this embodiment, first packer seal 190 of piston 180 sealingly engages the lower surface 356 of elastomeric body 350 to augment the sealing integrity between elastomeric body 350 and piston 180; however, in other embodiments, piston 180 may not include first packer seal 190. For clarity, the elastomeric body 350 of elastomeric packer 300 is hidden in FIG. 3.

As shown particularly in FIGS. 5-8, each insert 302 of elastomeric packer 300 includes a first or upper end comprising an upper member or web 304, a second or lower end comprising a lower member or heel 310, and a link or rib 320 extending between the web 304 and heel 310. In this embodiment, an upper end of the web 304 of each inert 302 includes an extension 305 extending therefrom. Although in this embodiment each insert 302 includes an extension 305, in other embodiments, inserts 302 may not include extensions 305. Additionally, each web 304 includes a laterally extending (relative a longitudinal axis of the insert 302) first or upper interlock 306 positioned at a first lateral side of web 304 and a first or upper mating surface 307 disposed laterally opposite the upper interlock 306 at a second lateral side of web 304 opposite the first lateral side. Similarly, in this embodiment, the heel 310 of each insert 302 includes a laterally extending second or lower interlock 312 positioned at a first lateral side of heel 310 and a second or lower mating surface 314 disposed laterally opposite the lower interlock 312 at a second lateral side of heel 310 opposite the first lateral side.

In this embodiment, each insert 302 of elastomeric packer 300 also includes a first or intermediate link 330 pivotally coupled to a lower end of rib 320 and a second link or foot 340 pivotally coupled to intermediate link 330. Particularly, the intermediate link 330 of each insert 302 has a first or outer end that receives a first pin 332 that extends through rib 320, thereby pivotally coupling the outer end of intermediate link 330 with the rib 320. Additionally, the intermediate link 330 of each insert 302 has a second or inner end that receives a second pin 334 that extends through a first or inner end of the foot 340, thereby pivotally coupling the inner end of intermediate link 330 with the outer end of the foot 340. The pivotable foot 340 of each insert 302 includes a laterally extending third or foot interlock 342 positioned at a first lateral side of foot 340 and a third or foot mating surface 344 disposed laterally opposite the foot interlock 342 at a second lateral side of foot 340 opposite the first lateral side.

Upper interlocks 306 and corresponding mating surfaces 307 may be referred to as upper interlocks 306, 307 of elastomeric packer 300 while lower interlocks 312 and corresponding mating surfaces 314 may be referred to as lower interlocks 312, 314, and feet interlocks 342 and corresponding mating surfaces 344 may be referred to as feet interlocks 342, 344. In this embodiment, interlock 342 of the foot 340 arcuately or circumferentially overlaps the mating surface 344 of the foot 340 of an adjacently positioned insert 402 such that no arcuate gap is formed between adjacently positioned feet 340, irrespective of whether annular BOP 100 is in the open or closed positions. In this embodiment, interlocks 306, 312, and 342 of each insert 302 comprise substantially planar surfaces configured to slidably engage mating surfaces 307, 314, and 344, respectively; however, in other embodiments, the geometry of interlocks 306, 312, and 342, and mating surfaces 307, 314, and 344 may vary.

Figure 11:
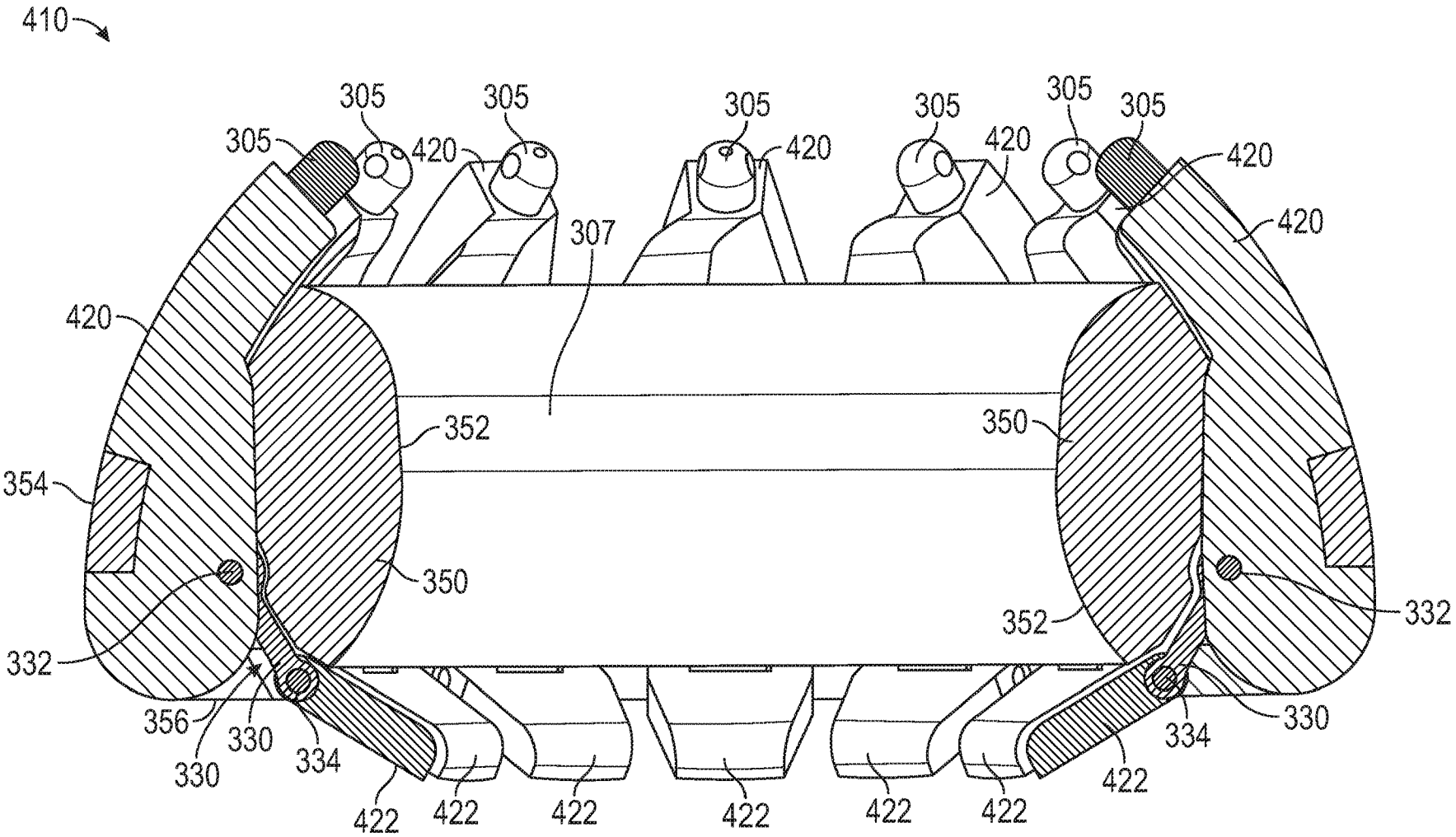
FIG. 11 is a side cross-sectional view of another embodiment of an elastomeric packer of the annular BOP of FIG. 2 in accordance with the principles disclosed herein.
Figure 12:
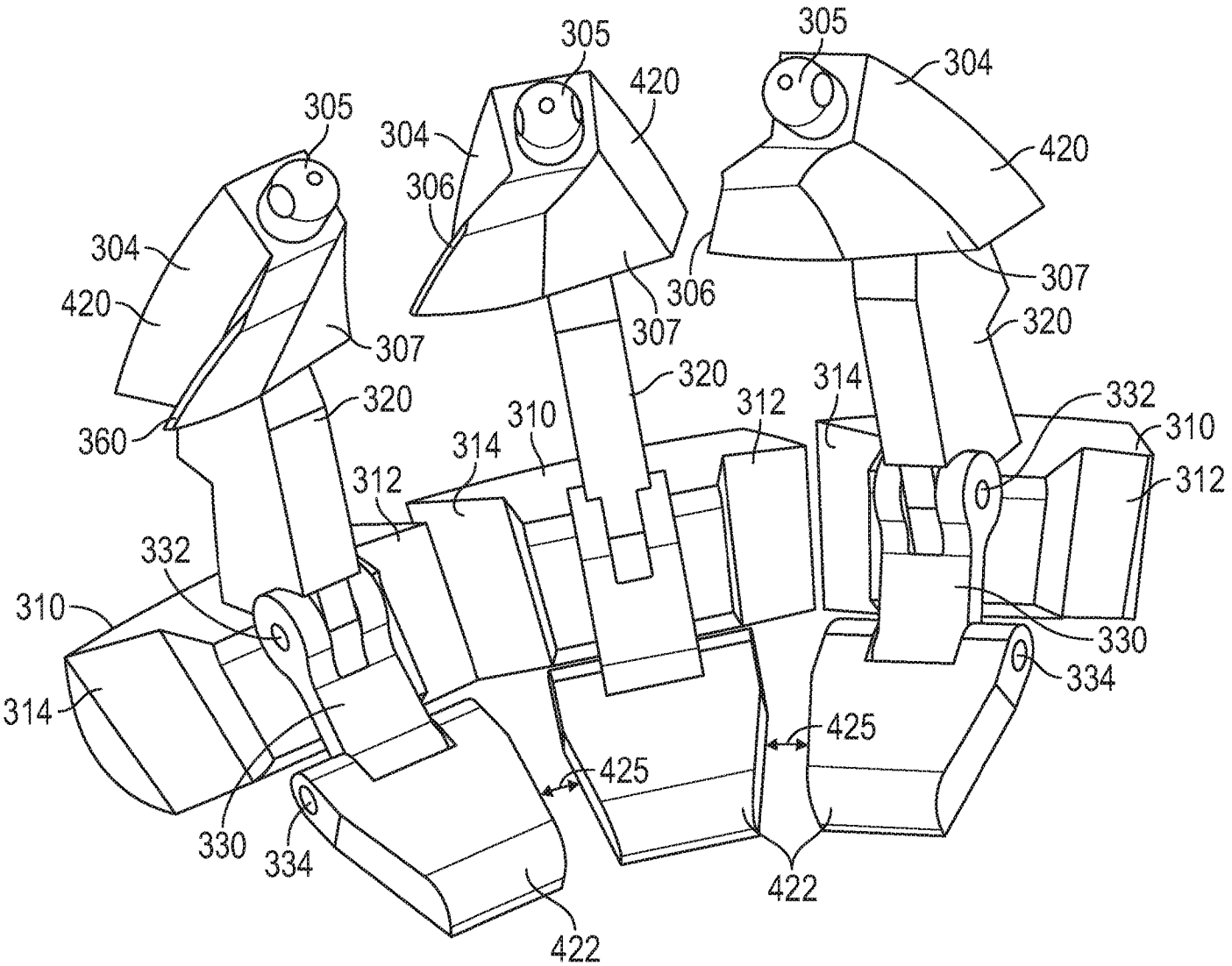
FIG. 12 is a perspective view of an embodiment of a plurality of inserts of the elastomeric packer of FIG. 11 in accordance with the principles disclosed herein.

Although in this embodiment each insert 302 includes a foot 340 with a foot interlock 342 and a corresponding mating surface 344, in other embodiments, each foot 340 may not include an interlock 342 and/or a mating surface 344. For example, referring briefly to FIGS. 11, 12, another embodiment of an elastomeric packer 410 of annular BOP 100 is shown. Elastomeric packer 410 includes features in common with elastomeric packer 300 shown in FIGS. 2-9, and shared features are labeled similarly. Particularly, in the embodiment of FIGS. 11, 12, elastomeric packer 410 generally includes elastomeric body 350 and a plurality of circumferentially spaced inserts 420 coupled thereto. Each insert 420 of elastomeric packer 410 includes a foot 422 pivotally coupled to the rib 320 of the insert 420 via intermediate link 330. In this embodiment, the foot 422 of each insert 420 does not include either an interlock or a corresponding mating surface. Thus, in this embodiment, an arcuate gap (shown schematically in FIG. 12 by arrows 425) extends between the foot 422 of each adjacently positioned insert 420 of elastomeric packer 410 when annular BOP 100 is in the open position.

Referring again to FIGS. 2-9, when annular BOP 100 is in the open position shown in FIG. 2, the feet 340 of elastomeric packer 300 are each positioned at an incline relative central axis 105 that is parallel to the incline of the inner engagement surface 188 of piston 180. In this arrangement, the second packer seal 192 of piston 180 sealingly engages an outer surface of each foot 340 of elastomeric packer 300 while the first packer seal 190 sealingly engages the lower surface 356 of elastomeric body 350 which is located radially between each foot 340 and the heel 310 of the insert 302 to which it is pivotally coupled. Thus, packer seals 190, 192 provide a dual seal barrier at the interface formed between piston 180 and elastomeric packer 300. Additionally, in this embodiment, a minimum inner diameter of the central passage 185 of piston 180 is the same or greater in size than a minimum inner diameter of the central passage 307 of elastomeric packer 300 when annular BOP 100 is in the open position. In this embodiment, some or all of the interlocks 306, 312 of each insert 302 may be circumferentially spaced from the mating surfaces 307, 314 of an adjacently positioned insert 302 when the annular BOP 100 and elastomeric packer 300 are in the open position. For example, the upper interlock 306 of each insert 302 is circumferentially spaced from the upper mating surface 307 of an adjacently positioned insert 302 when annular BOP 100 and elastomeric packer 300 are in the open position.

When annular BOP 100 is actuated from the open position shown in FIG. 2 to the closed position shown in FIG. 3, the hemispherical surface 146 of upper housing 140 compresses the elastomeric body 350 of elastomeric packer 300 radially inwards towards central axis 105 to force the inner surface 352 of elastomeric body 350 into sealing engagement with the outer surface of the drill string 24. In some applications, including applications where the drilling fluid flowing along annular flowpath 38 is at an elevated temperature, the elastomeric body 350 of packer 300 may deform in response to the actuation of annular BOP 100 from the open position to the closed position. Inserts 302 of elastomeric packer 300 are configured to prevent portions of elastomeric body 350 from extruding axially past (e.g., above or below) or radially between inserts 302 such that elastomeric body 350 is trapped radially between the circumferentially spaced inserts 302 and the outer surface of drill string 24 to maintain sealing integrity between elastomeric body 350 and the outer surface of drill string 24.

Particularly, extensions 305 of inserts 302, which are also displaced radially inwards towards central axis 105 in response to the actuation of annular BOP 100 to the closed position, restrict elastomeric body 350 from extruding upwards and axially past extensions 305 of inserts 302, thereby trapping the upper end of the elastomeric body 350 against the outer surface of drill string 24. Additionally, when annular BOP 100 is in the closed position, there is no arcuate gap extending between adjacently disposed upper interlocks 306 and 307, lower interlocks 312 and 314, and feet interlocks 342, 344, respectively. In other words, when annular BOP 100 is in the closed position: each upper interlock 306 circumferentially overlaps with, and matingly engages, a corresponding mating surface 307, each lower interlock 312 overlaps with, and matingly engages, a corresponding mating surface 314, and each foot interlock 342 overlaps with, and matingly engages, a corresponding mating surface 344. With interlocks 306, 312, and 342 in overlapping arrangements with mating surfaces 307, 314, and 344, respectively, elastomeric body 350 is at least substantially prevented from extruding radially between adjacent inserts 302 of elastomeric packer 300, thereby maximizing the sealing integrity formed between elastomeric body 350 and the outer surface of drill string 24. Further, when annular BOP 100 is in the closed position, feet 340 of inserts 302 cradle the lower end of elastomeric body 350 to prevent body 350 from extruding or flowing axially below feet 340, thereby trapping the lower end of elastomeric body against the outer surface of drill string 24 to maximize sealing integrity between elastomeric body 350 and the outer surface of drill string 24. Thus, extensions 305 of inserts 302 prevent the upper end of elastomeric body 350 from escaping the annular space surrounded by inserts 302 while feet 340 of inserts 302 prevent the lower end of elastomeric body 350 from escaping the annular space surrounded by inserts 302. Moreover, as described above, packer seals 190, 192 increase the integrity of the seal formed at the interface between piston 180 and elastomeric packer 300.

Figure 13:
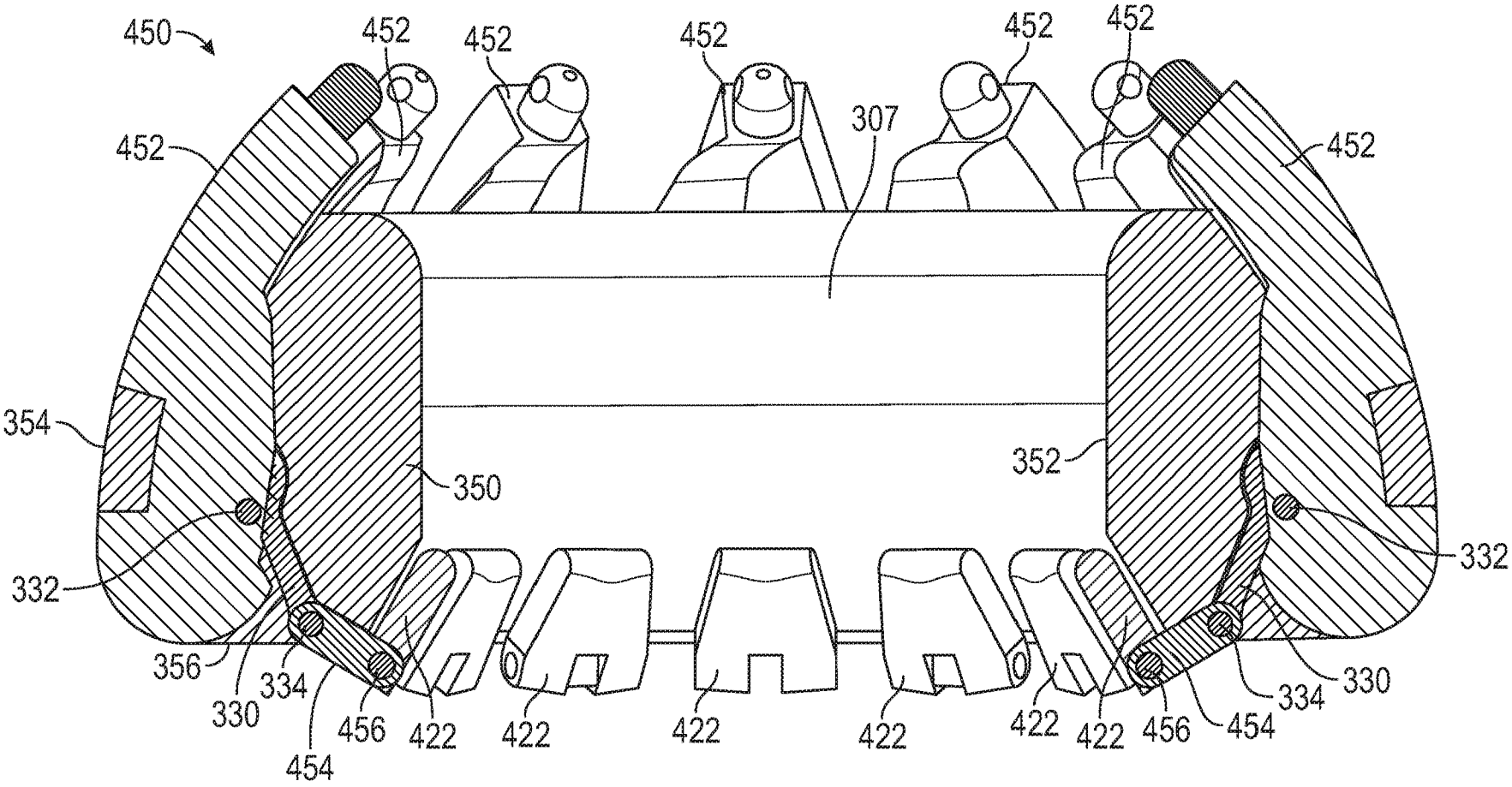
FIG. 13 is a side cross-sectional view of another embodiment of an elastomeric packer of the annular BOP of FIG. 2 in accordance with the principles disclosed herein.

Referring to FIG. 13, another embodiment of an elastomeric packer 450 of annular BOP 100 is shown. Elastomeric packer 450 includes features in common with packer 300 described above, and shared features are labeled similarly. Elastomeric packer 450 generally includes elastomeric body 350 and a plurality of circumferentially spaced inserts 452 coupled thereto. In the embodiment of FIG. 13, each insert 452 of packer 450 includes both intermediate link 330 (referred to as first link 330 in this embodiment) and a second link 454 pivotally coupled to first link 330 via second pin 334. Additionally, each insert 452 includes a foot 422 pivotally coupled to second link 454 via a third pin 456. Thus, the foot 422 of each insert 452 is pivotable about each of pins 332, 334, and 456. In this embodiment, the foot 422 of each insert 452 is disposed at an angle relative to the inner engagement surface 188 of piston 180, cradling the lower end of elastomeric body 350. In this embodiment, a circumference defined by the radially inner ends of circumferentially spaced feet 422 has a minimum diameter the same size or greater than the minimum diameter 185 of piston 180 when annular BOP 100 is in the open position. In this embodiment, an upper surface of each foot 422 is adhered or frictionally coupled to the inner surface 352 of elastomeric body 350 via the adhesive or frictional quality of the elastomeric material comprising body 350. In this manner, feet 422 may pivot in response to deformation if elastomeric body 350 such that feet 422 remain attached to inner surface 352 of elastomeric body 350 during the actuation of annular BOP 100 between the open and closed positions.

Figure 14:
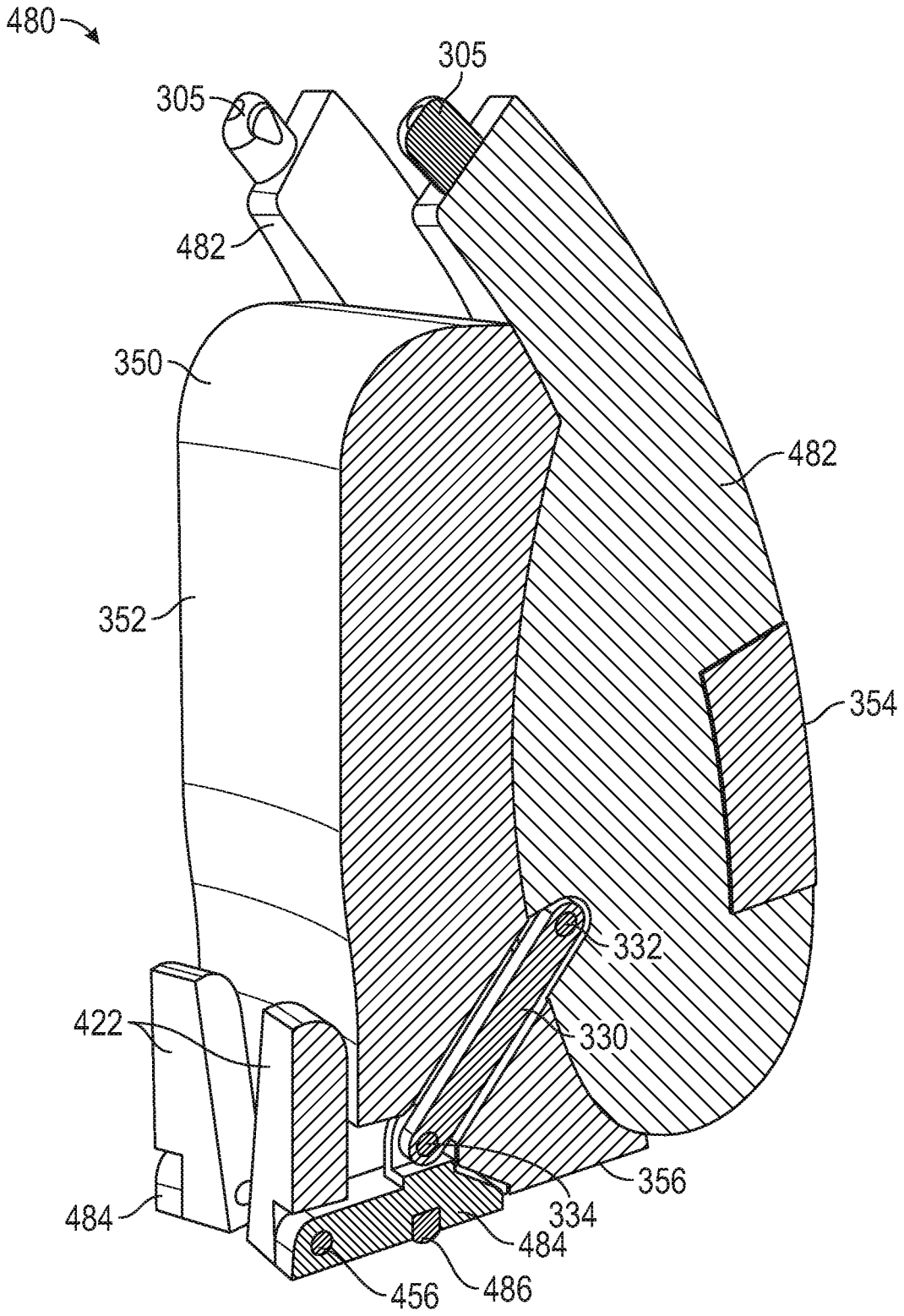
FIG. 14 is a perspective cross-sectional view of another embodiment of an elastomeric packer of the annular BOP of FIG. 2 in accordance with the principles disclosed herein.

Referring to FIG. 14, another embodiment of an elastomeric packer 480 of annular BOP 100 is partially shown in FIG. 14. Elastomeric packer 480 includes features in common with packers 300, 450 described above, and shared features are labeled similarly. Elastomeric packer 480 generally includes elastomeric body 350 and a plurality of circumferentially spaced inserts 482 coupled thereto. In the embodiment of FIG. 14, each insert 482 includes a second link 484 pivotally coupled between first link 330 and foot 422. In the embodiment of FIG. 14, each second link 484 includes a groove that receives at least a portion of an annular seal 486 extending about the central passage 307 of elastomeric packer 480. Second link 484 is supported on outer engagement surface 186 of piston 180 with seal 486 in sealing engagement therewith when annular BOP 100 is in the open position. Thus, instead of placing seals in grooves formed in piston 180 (e.g., packer seals 190, 192), elastomeric packer 480 includes annular seal 486 for increasing the sealing integrity formed between piston 180 and packer 480.

Figure 16:
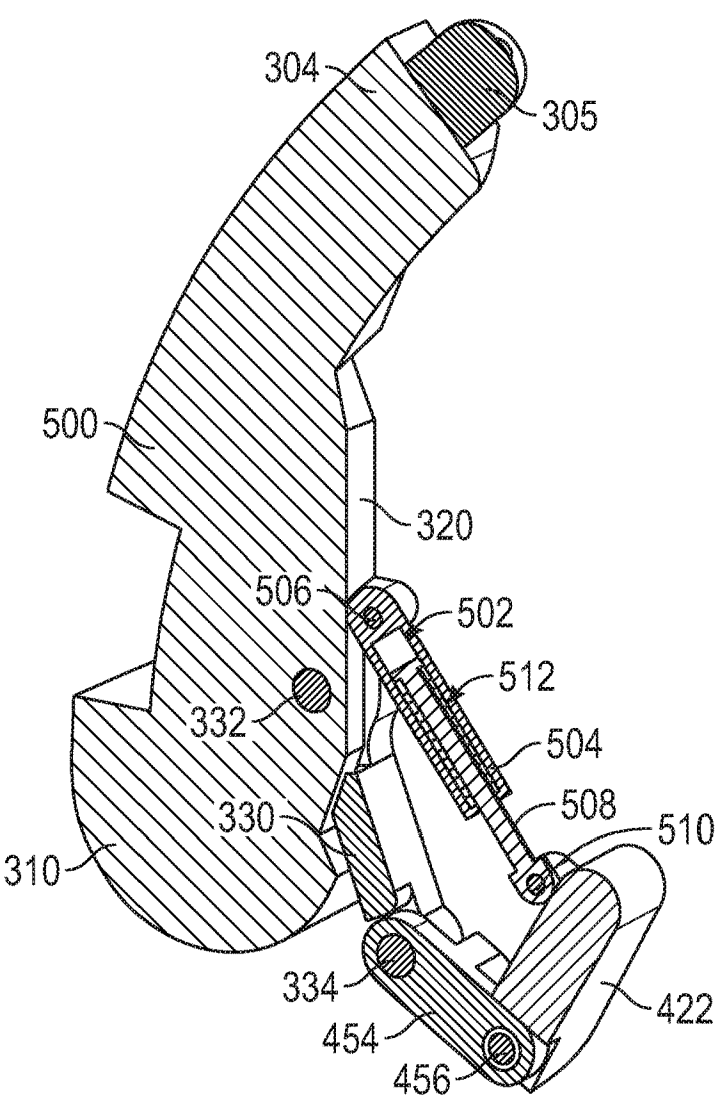
FIG. 16 is a perspective cross-sectional view of the insert of FIG. 15.
Figure 15:
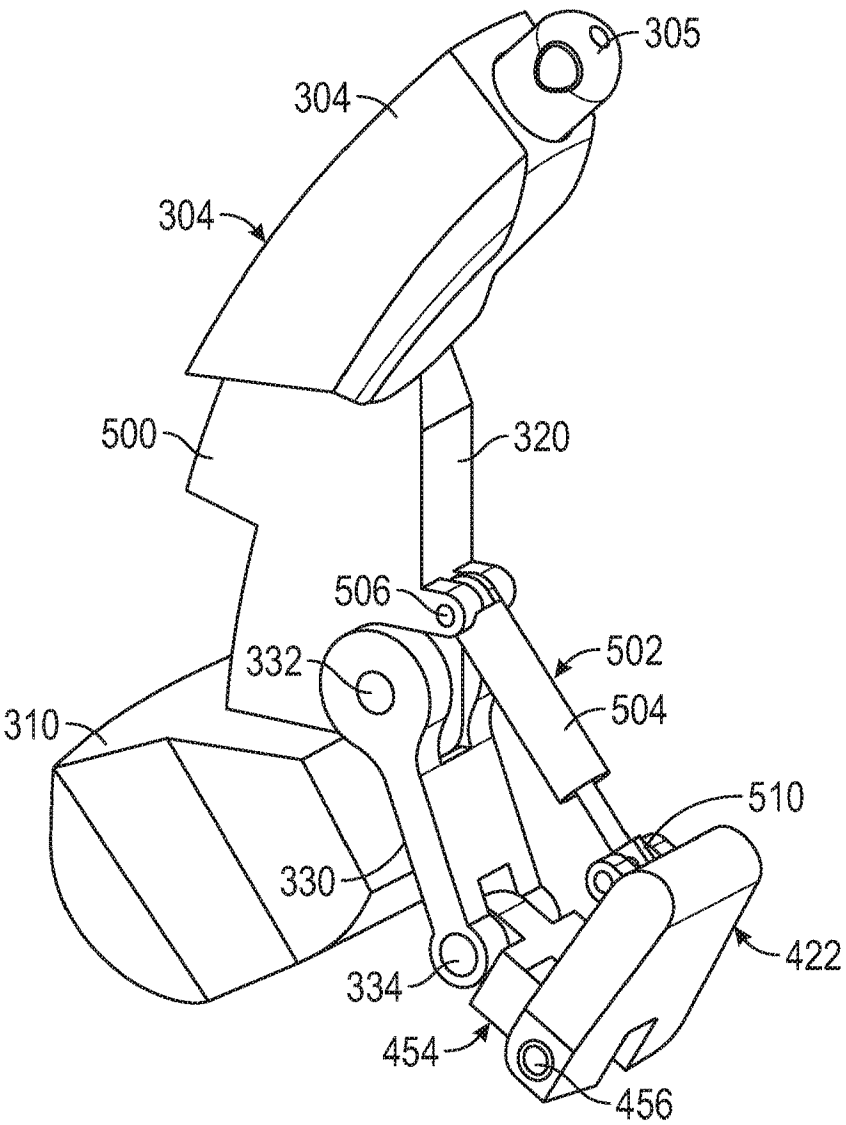
FIG. 15 is a perspective view of another embodiment of an insert of the annular BOP of FIG. 2 in accordance with the principles disclosed herein.

Referring to FIGS. 15, 16, another embodiment of an insert 500 for an elastomeric packer of the annular BOP 100 is shown. Insert 500 includes features in common with inserts 302, 452, and 482 described above, and shared features are labeled similarly. Insert 500 is similar to insert 452 shown in FIGS. 12, 13 except that insert 500 includes a biasing assembly 502 configured to bias foot 422 radially outwards in the direction of the inner surface 352 of elastomeric body 350 (not shown in FIGS. 15, 16) in the event that foot 422 becomes unattached therefrom. In the embodiment of FIGS. 15, 16, biasing assembly 502 includes a cylinder 504 pivotally coupled to the rib 320 of insert 500 via a first pin 506, a piston or mandrel 508 pivotally coupled to foot 422 via a second pin 510, and a biasing member 512 (e.g., a spring) disposed in cylinder 504 radially between an outer surface of mandrel 508 and an inner surface of cylinder 504. In this configuration, biasing member 512 of each insert 500 applies a biasing force against foot 422 in the radially outwards direction towards the inner surface 352 of elastomeric body 350.

Figure 17:
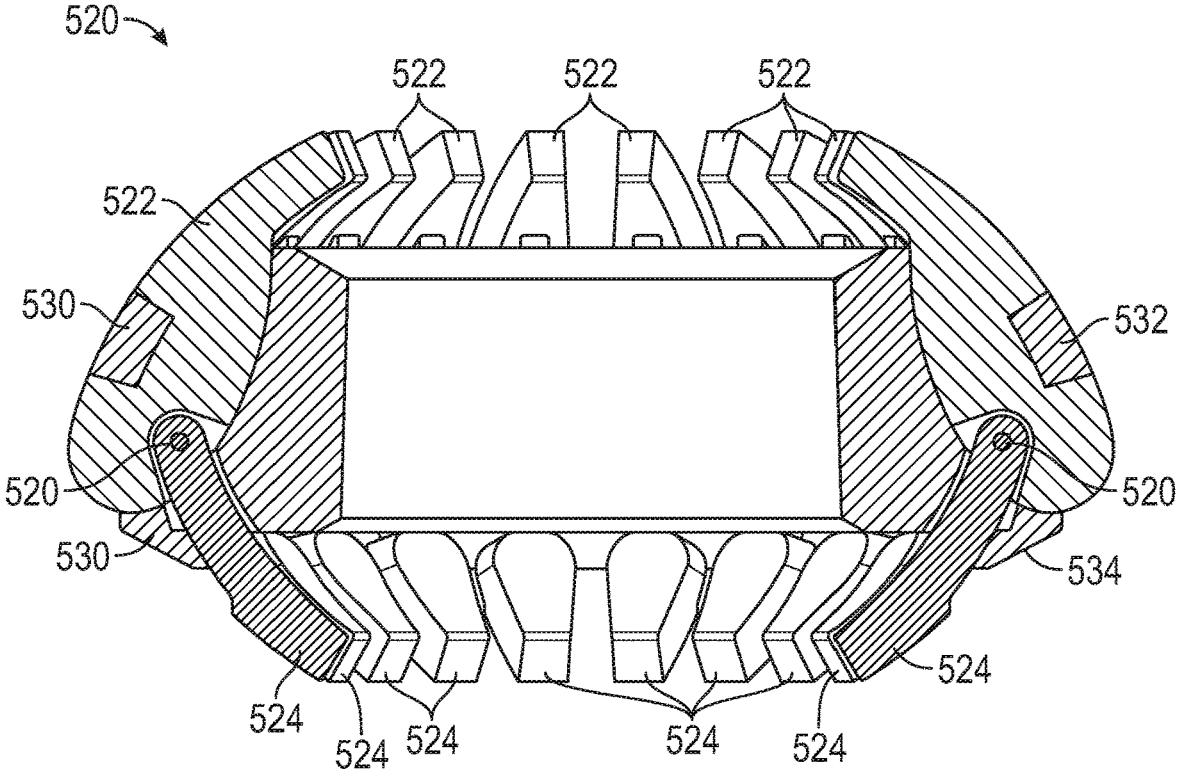
FIGS. 17-19 are side cross-sectional views of other embodiments of elastomeric packers of the annular BOP of FIG. 2 in accordance with the principles disclosed herein.

Referring to FIG. 17, another embodiment of an elastomeric packer 520 of the annular BOP 100 is shown. Elastomeric packer 520 includes features in common with packers 300, 450, and 480 described above, and shared features are labeled similarly. Elastomeric packer 520 generally includes a plurality of circumferentially spaced inserts 522 that are coupled or molded to an elastomeric body 530. In the embodiment of FIG. 17, each insert 522 includes a rib 523 and a foot 524 directly coupled to rib 523 via a rotatable pin or pivot joint 526. In this embodiment, elastomeric body 530 includes an outer sealing surface 532 and a frustoconical lower surface 534 configured to sealingly engage the inner engagement surface 188 of the piston 180 of annular BOP 100. In some embodiments, a lower surface of each foot 524 may be curved to sealingly engage a curved (e.g., concave) surface of piston 180.

Figure 18:
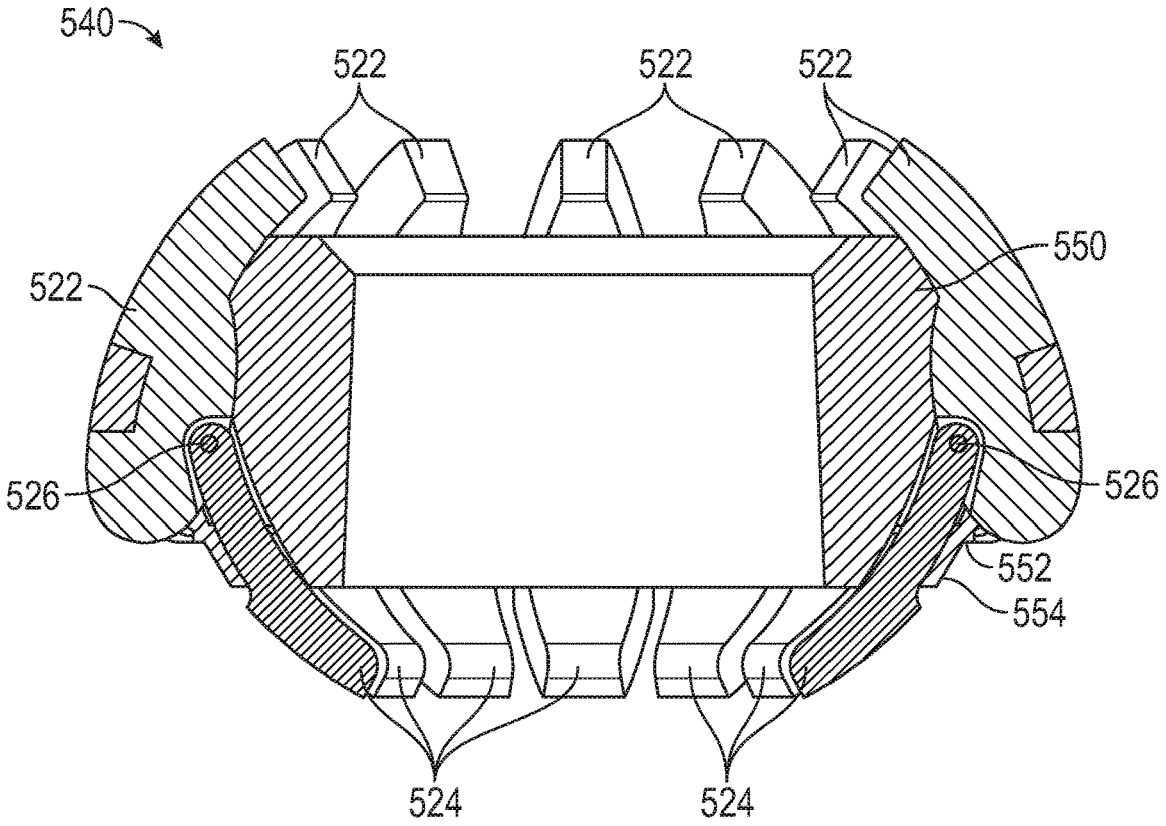
Figure 19:
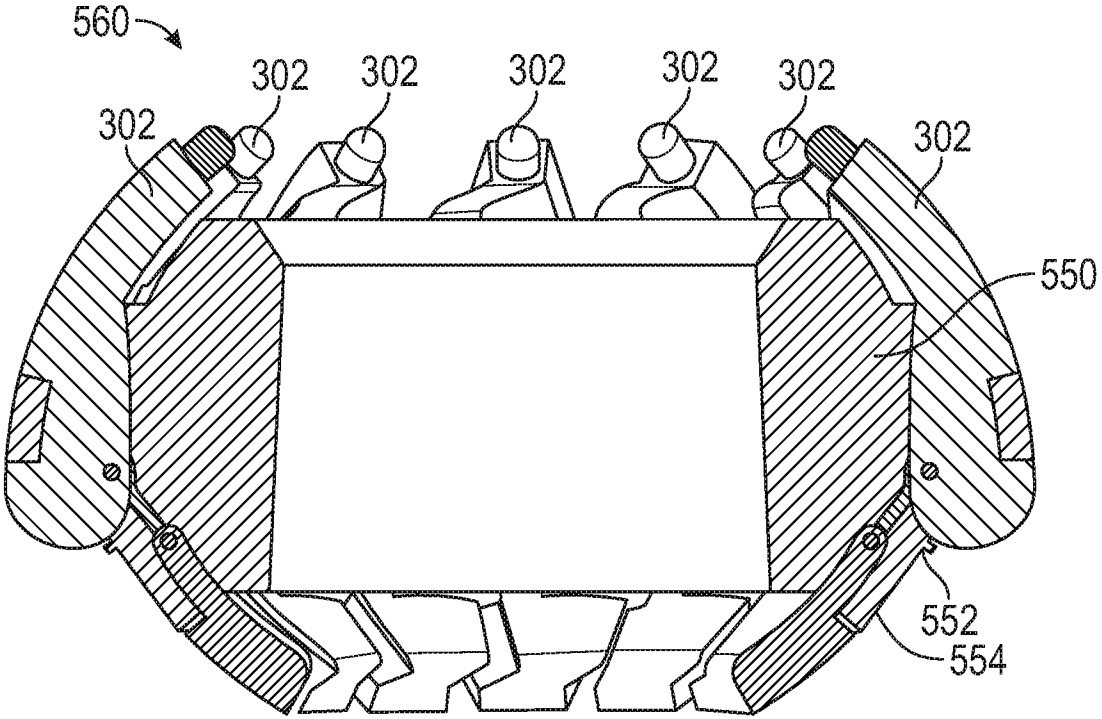

Referring to FIG. 18, another embodiment of an elastomeric packer 540 of the annular BOP 100 is shown. Elastomeric packer 540 includes features in common with packers 300, 450, 480, and 520 described above, and shared features are labeled similarly. Particularly, elastomeric packer 540 generally includes circumferentially spaced inserts 522 that are coupled or molded to an elastomeric body 550. In the embodiment of FIG. 18, elastomeric body 550 includes a lower surface that includes an annular outer engagement surface 552 and an annular inner or frustoconical engagement surface 554 that extends at an angle relative to outer engagement surface 552. In this embodiment, outer engagement surface 552 of elastomeric body 550 is configured to sealingly engage outer engagement surface 186 of piston 180 while inner engagement surface 554 is configured to sealingly engage the inner engagement surface 188 of piston 180. Referring briefly to FIG. 19, another embodiment of an elastomeric packer 560 of the annular BOP 100 is shown. In the embodiment of FIG. 19, elastomeric packer 560 generally includes circumferentially spaced inserts 302 that are coupled or molded to elastomeric body 550.

Figure 20:
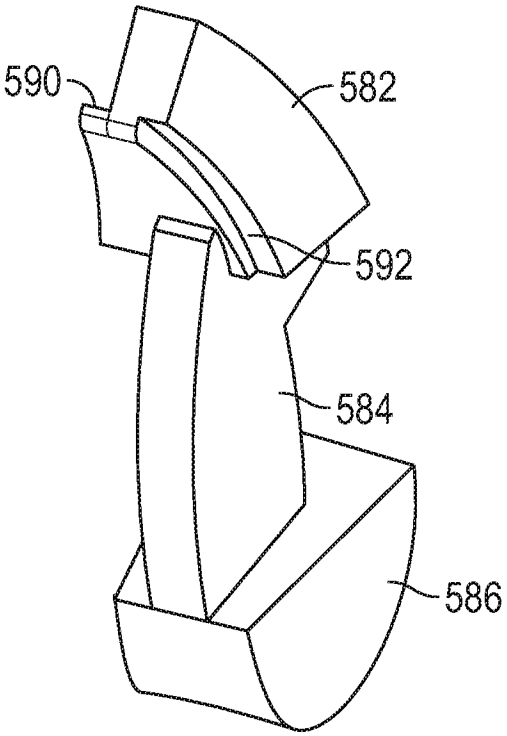
FIG. 20 is a perspective view of another embodiment of an insert of the annular BOP of FIG. 2 in accordance with the principles disclosed herein.

Referring to FIG. 20, another embodiment of an insert 580 for an elastomeric packer of the annular BOP 100 is shown. Insert 580 includes a web 582, a rib 584 coupled to web 582, and a heel 586 coupled to rib 584. In the embodiment of FIG. 20, insert 580 does not include an extension (e.g., extension 304 of insert 302) and the heel 586 of insert 580 does not include an interlock and corresponding mating surface. However, web 582 of insert 580 includes an upper interlock 590 and an upper mating surface 592 disposed laterally opposite the upper interlock 590 for preventing an upper end of an elastomeric body (to which insert 580 is coupled) from being extruded axially between web 582 and the outer surface of drill string 24, thereby maintaining the sealing integrity between the elastomeric body and the outer surface of drill string 24 to thereby seal annular flowpath 38.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. An annular elastomeric packer for a blowout preventer, comprising:

a plurality of circumferentially spaced inserts each comprising a rib, a foot, and a link pivotally coupled to the foot whereby the foot is pivotably coupled to the rib through the link; and an elastomeric body coupled to the plurality of inserts and defining an annular outer surface and an annular inner surface;

wherein the foot of each insert is configured to pivot whereby a portion of the foot located external the elastomeric body presses against the inner surface of the elastomeric body in response to deformation of the elastomeric body in response to the blowout preventer actuating from a first position to a second position.

2. The elastomeric packer of claim 1, wherein each insert comprises:

a web and a heel, the rib being coupled between the web and the heel;

wherein the web comprises an interlock configured to overlap a mating surface of a web of an adjacently positioned insert in response to the blowout preventer actuating from a first position to a second position.

3. The elastomeric packer of claim 1, wherein each insert comprises a web and a heel, the rib being coupled between the web and the heel, wherein at least one of the heel and the web comprise an interlock configured to circumferentially overlap a mating surface of at least one of the heel and the web of an adjacently positioned insert in response to the elastomeric packer actuating from a first position to a second position.

4. The elastomeric packer of claim 1, wherein the foot of each insert comprises an interlock configured to circumferentially overlap a mating surface of the foot of an adjacently positioned insert in response to the elastomeric packer actuating from a first position to a second position.

5. The elastomeric packer of claim 1, wherein each insert comprises a spring configured to retract the foot towards the rib of the insert.

6. The elastomeric packer of claim 5, wherein the link comprises a groove that receives an annular seal configured to sealingly engage a piston of the blowout preventer.

7. An annular blowout preventer, comprising:

an outer housing;

the elastomeric packer of claim 1;

a piston slidably disposed in the outer housing and configured to actuate the blowout preventer from the first position to the second position.

8. the blowout preventer of claim 7, wherein the piston is configured to actuate the elastomeric packer into sealing engagement against a tubular member.

9. The blowout preventer of claim 7, wherein the piston comprises an annular seal configured to sealingly engage the elastomeric body of the elastomeric packer.

10. The blowout preventer of claim 7, wherein the piston comprises an annular seal configured to sealingly engage the foot of each of the plurality of inserts of the elastomeric packer.

* * * * *